US009480348B2

(12) United States Patent
Hull et al.

(10) Patent No.: US 9,480,348 B2
(45) Date of Patent: Nov. 1, 2016

(54) HOLIDAY CAROUSEL

(71) Applicants: Donna R Hull, Tacoma, WA (US); Dean F Hull, Tacoma, WA (US)

(72) Inventors: Donna R Hull, Tacoma, WA (US); Dean F Hull, Tacoma, WA (US)

( * ) Notice: Subject to any disclaimer, the term of this patent is extended or adjusted under 35 U.S.C. 154(b) by 105 days.

(21) Appl. No.: 14/153,022

(22) Filed: Jan. 11, 2014

(65) Prior Publication Data

US 2015/0196142 A1 Jul. 16, 2015

(51) Int. Cl.

| | |
|---|---|
| ***A47F 5/02*** | (2006.01) |
| ***A47F 5/025*** | (2006.01) |
| ***A47G 33/08*** | (2006.01) |
| ***A47G 33/12*** | (2006.01) |

(52) U.S. Cl.

CPC ..... *A47F 5/025* (2013.01); *A47G 33/0809* (2013.01); *A47G 33/12* (2013.01); *A47G 33/126* (2013.01); *A47G 2033/122* (2013.01); *A47G 2033/1286* (2013.01)

(58) Field of Classification Search

CPC .. A47F 5/025; A47G 33/0809; A47G 33/12; A47G 33/126; A47G 2033/1286; A47G 2033/122

USPC ..... 248/521, 349.1, 522, 527, 523, 524, 248/499; 47/40.5

See application file for complete search history.

(56) References Cited

U.S. PATENT DOCUMENTS

| | | | | | |
|---|---|---|---|---|---|
| 1,394,386 | A * | 10/1921 | Wilske | A47G 33/12 | 248/519 |
| 1,468,247 | A * | 9/1923 | Patten | A47F 5/025 | 108/21 |
| 2,469,884 | A * | 5/1949 | Masone | A47G 33/126 | 191/1 R |
| 2,537,826 | A * | 1/1951 | Hauser | A47G 33/12 | 248/523 |
| 2,605,067 | A * | 7/1952 | Lindsell | A47G 33/12 | 248/176.1 |
| 2,735,223 | A * | 2/1956 | Brown, et al | A47G 33/12 | 446/136 |
| 2,847,175 | A * | 8/1958 | Farley | A47F 5/025 | 108/150 |

(Continued)

OTHER PUBLICATIONS frontgate.com; Golden Rotating Tree Stand; Golden Rotating Tree Stand; http://www.frontgate.com/webapp/wcs/stores/servlet/x/451568?SourceCode=ZZ51120&cm_mmc=Comparison%20Shopping-__-Google%20Product%20Listings-__-NA-__-NA&mr:trackingCode=606D2CD7-5BF0-E111-96D6-BC305BEDEAD8&mr:referralID=NA&mr:adType=pla&mr:ad=15619021529&mr:keyword=&mr:match=&mr:filter=37524446489&redirect=y.

*Primary Examiner* — Anita M King
(74) *Attorney, Agent, or Firm* — The Keys Law Firm PLLC

(57) ABSTRACT

A holiday carousel for allowing the exhibiting and viewing of live Christmas trees, artificial Christmas trees, or other holiday decorations to be secured and rotated so as to be viewed from all angles. The holiday carousel comprises a stationary base having a rotating turntable having extendable arms and an electrical outlet disposed thereon, as well as a live Christmas tree attachment for selectively attaching to the rotating turntable. The body of the rotating turntable extends outward beyond circumference of the stationary base and downward beyond the exterior edge of the stationary base so as to prevent environmental conditions from interfering with the operation of the holiday carousel.

4 Claims, 6 Drawing Sheets

(56) References Cited

U.S. PATENT DOCUMENTS

| | | | | | |
|---|---|---|---|---|---|
| 3,038,688 | A * | 6/1962 | Thorburn | A47G 33/12 | 248/523 |
| 3,042,350 | A * | 7/1962 | Lencioni | A47G 33/126 | 248/522 |
| 3,839,131 | A | 10/1974 | Christiansen | | |
| 4,344,243 | A | 8/1982 | Reszka | | |
| 5,190,261 | A * | 3/1993 | Tetting | A47G 33/126 | 211/163 |
| 5,255,886 | A * | 10/1993 | Wang | A47G 33/126 | 248/349.1 |
| 5,647,569 | A * | 7/1997 | Sofy | A47G 33/126 | 248/522 |
| 5,921,022 | A * | 7/1999 | Baker | A47G 33/126 | 47/39 |
| 6,572,064 | B1 | 6/2003 | Letson | | |
| 6,739,566 | B1 * | 5/2004 | Kao | A47G 33/126 | 248/519 |
| 6,953,179 | B2 * | 10/2005 | Lai | A47G 33/12 | 248/521 |
| 7,021,598 | B2 | 4/2006 | Kao | | |
| 7,028,968 | B2 | 4/2006 | Washick | | |
| 7,314,203 | B2 * | 1/2008 | Yue | F16M 11/08 | 248/131 |
| 8,276,871 | B1 | 10/2012 | Derienzo | | |
| 2012/0225222 | A1 | 9/2012 | Ochi | | |
| 2013/0140421 | A1 * | 6/2013 | Hammond | A47G 33/1226 | 248/523 |

* cited by examiner

HOLIDAY CAROUSEL

BACKGROUND OF THE INVENTION

1. Field of the Invention

This invention relates generally to display stands and, more particularly, to a rotating display stand adapted to hold decorative items and display plurality of angles of such items.

2. Description of the Prior Art

Decorations for various customs and occasions and generally observed in most human cultures. In many Western cultures, the Christmas season is a time when many individuals and families desire to display decorative items, including but not limited to Christmas trees, both inside and outside their dwelling or place of business. As a part of displaying Christmas trees and many other decorative items, a stand is typically employed to hold the item upright as well as to stabilize it and perform other necessary functions which may vary depending on the particular decorative item and its characteristics.

While Christmas decorations have been used for centuries, one relatively recent innovation is the use of a stand for decorative items which rotates so as to display the decorative item from all angles. A problem which still exists, however, existing Christmas decoration stands are either stationary or, if they include some form of automatic motion, are limited to indoor use. Thus, there remains a need for a holiday carousel which provides a rotating stand for a holiday decorative item which was able to withstand unpredictable weather and adverse environmental conditions so as to be capable of being employed indoors or outdoors. It would be helpful if such a holiday carousel was configurable to hold Christmas decorations such as live and artificial Christmas trees. It would be additionally desirable for such a holiday carousel to be configurable to hold Christmas decorations other than Christmas trees.

The Applicant's invention described herein provides for a holiday carousel for supporting and rotating a Christmas decoration in any setting. The primary components of Applicant's holiday carousel are a stationary base, a rotating turntable, and a securing mechanism. When in operation, the holiday carousel allows a user to use motion to attract and hold the attention of a viewer of one of many types of holiday decorations which is located either indoors or outdoors. As a result, many of the limitations imposed by the display structures in the prior art are removed.

SUMMARY OF THE INVENTION

A holiday carousel for allowing the exhibiting and viewing of live Christmas trees, artificial Christmas trees, or other holiday decorations to be secured and rotated so as to be viewed from all angles. The holiday carousel comprises a stationary base having a rotating turntable having extendable arms and an electrical outlet disposed thereon, as well as a live Christmas tree attachment for selectively attaching to the rotating turntable. The body of the rotating turntable extends outward beyond circumference of the stationary base and downward beyond the exterior edge of the stationary base so as to prevent environmental conditions from interfering with the operation of the holiday carousel.

It is an object of this invention to provide a holiday carousel which has a rotating stand for a holiday decorative item which was able to withstand unpredictable weather and adverse environmental conditions so as to be capable of being employed indoors or outdoors.

It is another object of this invention to provide a holiday carousel which is configurable to hold Christmas decorations such as live and artificial Christmas trees.

It is yet another object of this invention to provide a holiday carousel which is configurable to hold Christmas decorations other than Christmas trees.

These and other objects will be apparent to one of skill in the art.

DETAILED DESCRIPTION OF THE INVENTION

Figure 1:
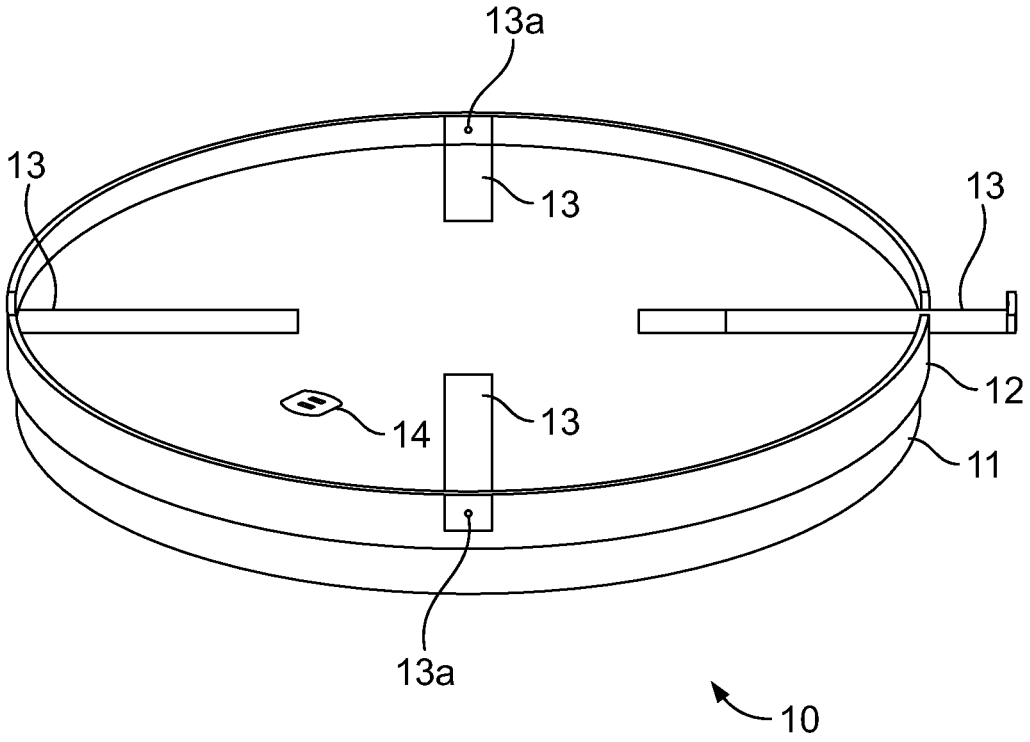
FIG. 1 is a side perspective view of a holiday carousel built in accordance with the present invention.

Referring now to the drawings and in particular FIG. 1, a holiday carousel 10 is shown having a stationary base 11 with a rotating turntable 12 disposed thereon. The rotating turntable 12 includes four extendable arms 13 to allow decorative items to be tied to the rotating turntable 12 and a turntable outlet 14 to allow a decoration to be plugged in to access electrical power. The extendable arm 13 disposed on the right side is shown in its extended state and the other extendable arms 13 are shown in their base state.

Internally, the stationary base 11 includes a belt driven rotator to rotate the rotating turntable. To reduce friction during rotation, the exterior contact point between the stationary base 11 and the rotating turntable includes a circular bearing. Beyond the exterior contact point, the rotating turntable 12 extends outward beyond circumference of the stationary base 11, and downward beyond the exterior edge of the stationary base 11. This design provides for the weatherproofing aspect of the holiday carousel 10

Figure 2:
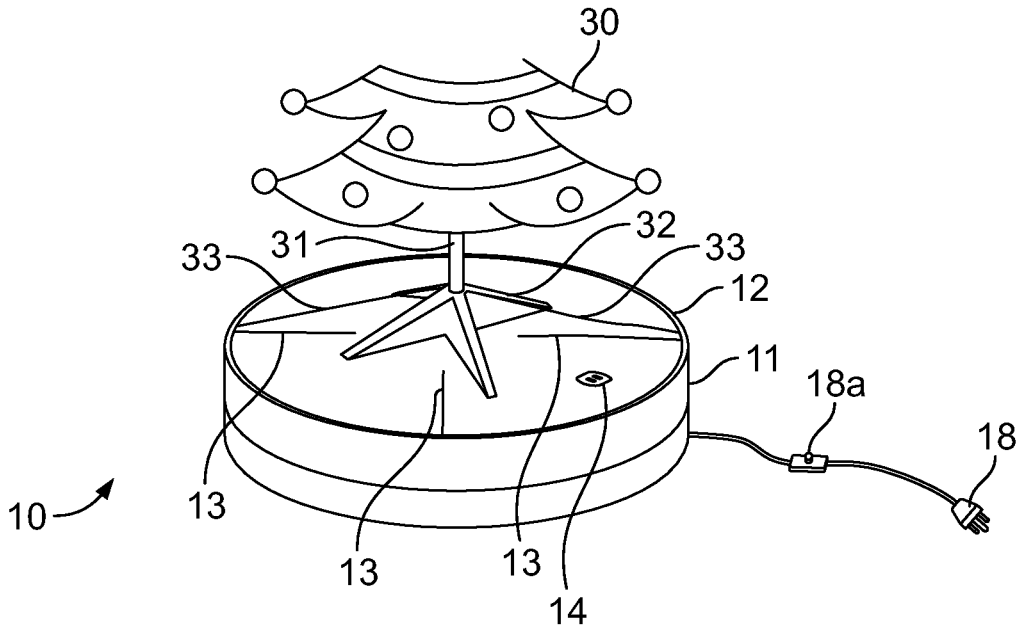
FIG. 2 is a side perspective view of a holiday carousel built in accordance with the present invention having an artificial Christmas tree disposed thereon.

Referring now to FIGS. 1 and 2, the holiday carousel 10 is shown with a conventional artificial Christmas tree 30 disposed thereon. For conventional artificial Christmas trees 30, the stand 32 of the artificial Christmas tree stand is placed on top of the rotating turntable 12. If desired by a user to provide additional stabilization of the artificial Christmas tree 30, the artificial Christmas tree 30 can also be secured with tie down string 33 which is tied to the extendable arms 13, which include a string aperture 13*a* configured to allow a tie down string to pass through the surface of the extendable arm 13.

Figure 3:
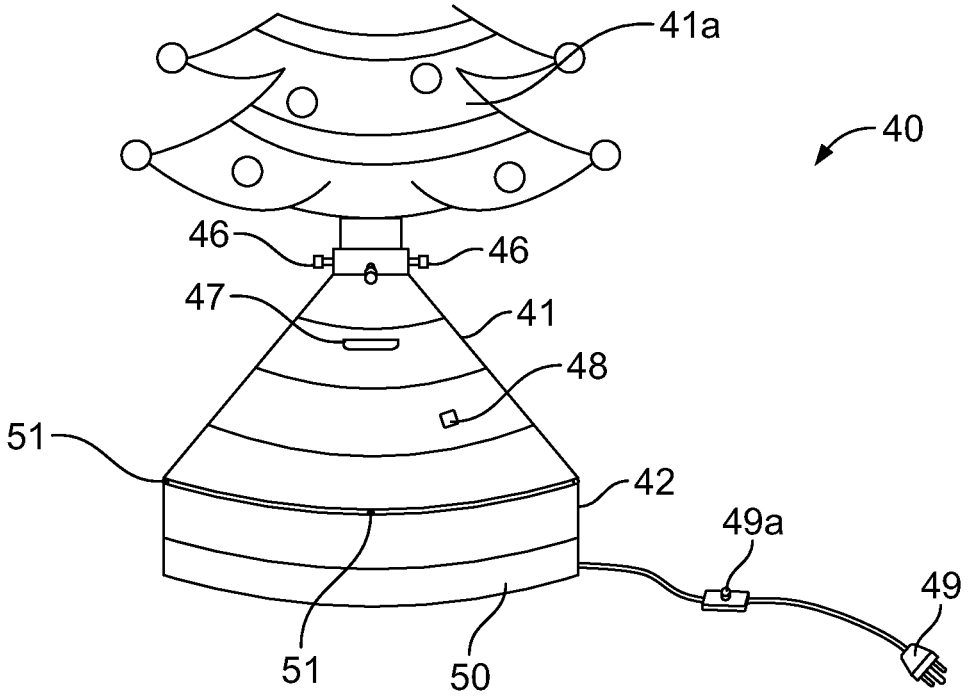
FIG. 3 is a side elevational view of a holiday carousel with live Christmas tree accessory built in accordance with the present invention having an live Christmas tree disposed thereon.
Figure 4:
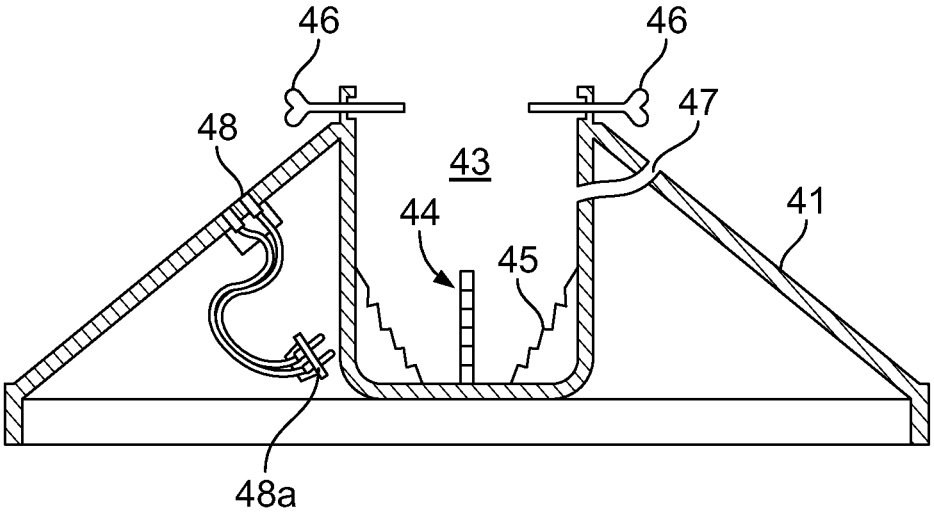
FIG. 4 is a side elevational view of the live Christmas tree accessory built in accordance with the present invention.
Figure 5:
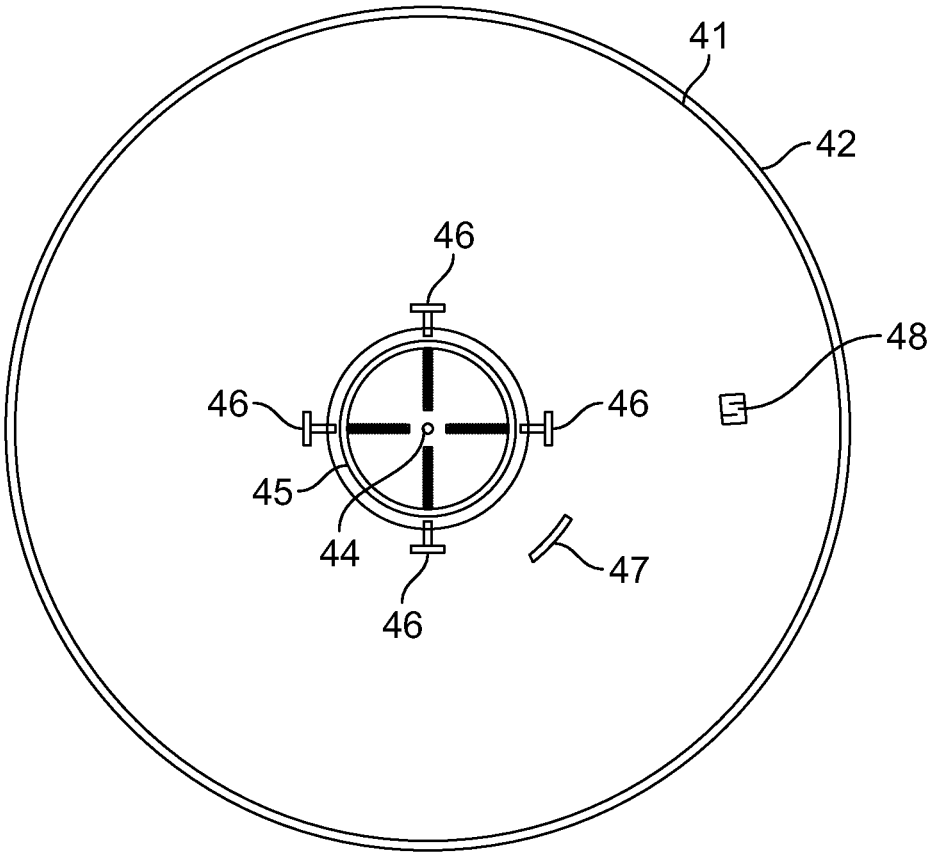
FIG. 5 is a top plan view of the live Christmas tree accessory built in accordance with the present invention.

Referring now to FIGS. 3, 4, and 5, the holiday carousel 40 is shown having a live Christmas tree attachment 41 disposed thereon. The live Christmas tree attachment 41 is a conical shaped structure which is adapted to be secured to the top of the rotating turntable 42 of the holiday carousel 40. The live Christmas tree attachment 41 includes a receiving reservoir 43 which has a tree securing screw 44 and narrowing jagged walls 45 so as to allow it to receive and secure the trunk of a live Christmas tree 41*a* and also hold water. Additional securing structures for a live Christmas tree 41*a* are located at the mouth of the receiving reservoir 43 as live tree screws 46, which operate as common securing screws do in conventional live Christmas tree stands. The external surface of the live Christmas tree attachment 41 includes a well hole 47, which allows water to be added to the receiving reservoir 43 without moving the live Christmas tree 41*a*, and an attachment outlet 48, which provides the lights or ornaments on a live Christmas tree 41*a* access to electrical power. The attachment outlet 48 is connected to an attachment plug 48*a*, which is to be plugged into the turntable outlet on the rotating base 42 so as to indirectly access electrical power from the base plug 49 on the stationary base 50 and be controlled by the on/off switch 49*a*. When the live Christmas tree attachment 41 is in use, the extendable arm 51 are placed in their base state and are unused.

Figure 6:
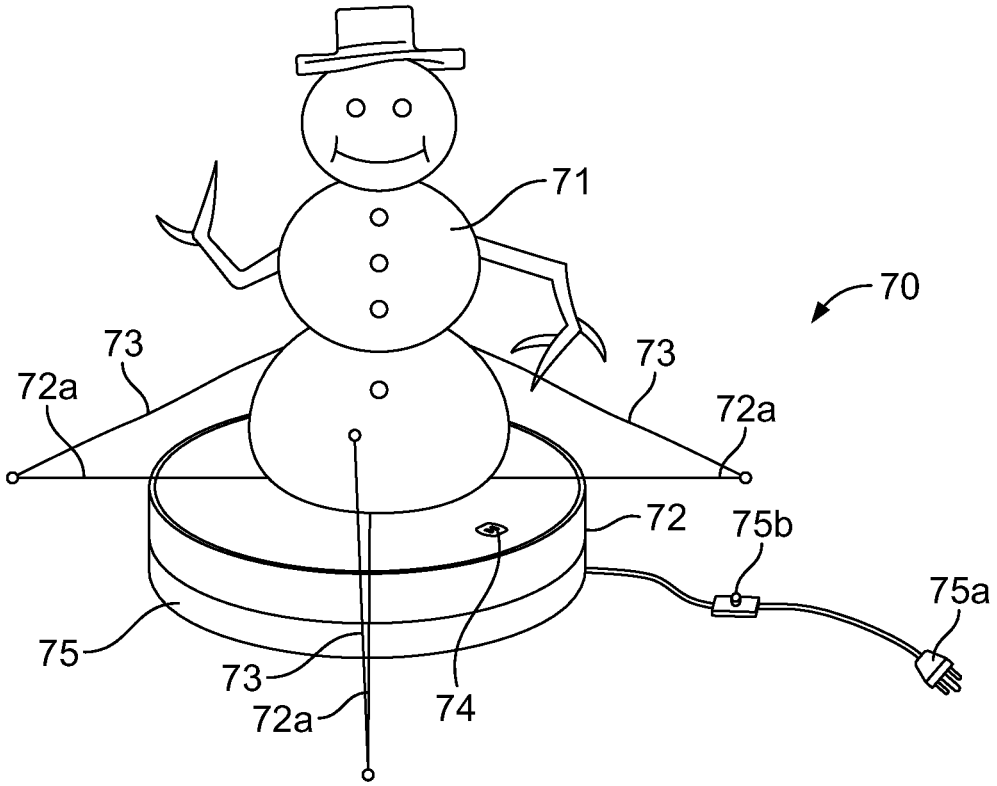
FIG. 6 is a side perspective view of a holiday carousel built in accordance with the present invention having an alternative holiday decoration disposed thereon.

Referring now to FIG. 6, the holiday carousel 70 is shown having a non-Christmas tree decoration embodied as a snowman 71 disposed thereon. The snowman 71 is secured to the extendable arms 72*a* of the rotating turntable 72 by way of tie down string 73. The extendable arms 72*a* are placed in their extended position in such a configuration so as to provide added leverage for the tie down sting 73. If the snowman 71 (or other decoration) requires electrical power, it can be plugged into the turntable outlet 74 so as to access electrical power which is available to the base plug 75*a*, and be toggled by the on/off switch 75*b*, attached to the stationary base 75. Because the extendable arms 72*a* and the turntable outlet 74 are part of the rotating turntable 72, however, the snowman 71 and all of its connection points rotate together so as to allow free and ongoing rotation.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A carousel for allowing the indoor or outdoor exhibiting of living or electrical items, comprising:

a stationary base having a cylindrical profile and an exterior edge and configured to rotate a structure disposed thereon when supplied with electrical power;

a rotating turntable having a body with a cylindrical profile and a substantially planar top surface suitable to receive and support a standing decoration on the top surface, at least one extendable arm and an electrical outlet disposed thereon, wherein said rotating turntable is disposed on said stationary base;

wherein the body of the rotating turntable extends outward beyond a circumference of the stationary base and downward beyond the exterior edge of the stationary base;

wherein said at least one extendable arm is selectively positionable in an extended state in which the at least one extendable arm extends radially beyond the body of the rotating turntable and a base state in which the at least one extendable arm is flush with the body of the rotating turntable; and wherein said rotating turntable is electrically connected to said stationary base in a manner which enables electrical power to be availed to said electrical outlet when electrical power is supplied with electrical power.

2. The carousel of claim 1, wherein said at least one extendable arm is adapted to enable a tie down string to be attached thereto so as to allow a structure disposed on the top surface turntable to be secured to said rotating turntable.

3. The carousel of claim 2, wherein said at least one extendable arm is integral with the top surface and adapted to be fixedly extended beyond the outer circumference of the rotating turntable.

4. The carousel of claim 1, additionally comprising a conical shaped structure which includes a receiving reservoir, a tree securing screw, and narrowing jagged walls, wherein said conical shaped structure is securable to said rotating turntable so as to completely cover the top surface.

* * * * *